United States Patent [19]

Koenig

[11] Patent Number: 4,951,884

[45] Date of Patent: Aug. 28, 1990

[54] POWER AUGER MACHINE WITH BEARING SHIELD

[76] Inventor: Larry E. Koenig, Komar Industries, 4425 Marketing Pl., Groveport, Ohio 43125

[21] Appl. No.: 345,330

[22] Filed: Apr. 28, 1989

[51] Int. Cl.[5] ..... B02C 19/22

[52] U.S. Cl. ..... 241/101.2; 198/672; 241/260.1; 277/53; 366/318; 384/480

[58] Field of Search ..... 425/207, 208; 277/53–57, 59; 366/318–324; 384/480; 198/672; 241/260.1, 101.2

[56] References Cited

U.S. PATENT DOCUMENTS

| | | | |
|---|---|---|---|
| 1,919,248 | 7/1933 | Murphy | 384/480 |
| 3,975,123 | 8/1976 | Schibbye | 277/59 X |
| 4,152,031 | 5/1979 | Magwire . | |
| 4,774,848 | 10/1988 | Zupanic | 198/672 X |
| 4,804,194 | 2/1989 | Hufford et al. . | |

FOREIGN PATENT DOCUMENTS

| | | | |
|---|---|---|---|
| 136714 | 10/1981 | Japan | 198/672 |
| 9610 | 1/1982 | Japan | 198/672 |

OTHER PUBLICATIONS

Non-Rubbing Seals for Oil Retention, David Spaulding, Product Engineering, 8-54.

*Primary Examiner*—Mark Rosenbaum
*Attorney, Agent, or Firm*—Thompson, Hine and Flory

[57] ABSTRACT

A bearing shield for a power auger machine having a bearing shield which includes an annular outer shield element attached to a rotating auger and having an annular channel formed in a rearward face thereof, an annular inner shield element attached to a wall which supports the auger and positioned within the annular channel such that a labyrinth seal is formed by the outer shield element, the inner shield element and the support wall, and a lubricant supply pump for forcing lubricant through the labyrinth seal and outwardly from between the outer shield element and the wall. In a preferred embodiment, a grease purge seal extends between the rear wall and bearing support structure for the auger to form a lubricant manifold communicating with the inner shield element and the labyrinth seal, for supplying lubricant to the labyrinth seal.

19 Claims, 3 Drawing Sheets

POWER AUGER MACHINE WITH BEARING SHIELD

BACKGROUND OF THE INVENTION

The present invention relates to power auger machines and, more particularly, to power auger machines having bearing shields interposed between rotating and nonrotating components.

Power auger machines, such as the auger shredder disclosed in Koenig U.S. Pat. No. 4,253,615, typically include a frame forming a grinding chamber with an upwardlyopening inlet hopper and either a side or bottom discharge opening. A rear wall of the grinding chamber supports an auger, mounted on a support disc, which is rotatably driven by a motor mounted within an enclosed housing. The wall includes a central opening through which a bearing plate extends. Materials to be processed by the rotating auger are deposited downwardly through the inlet opening and are ground, crushed and pumped outwardly through the discharge opening.

Frequently, hazardous, radioactive or highly corrosive materials are processed by such an auger and can contaminate or foul the main bearing or motor housing if the material works its way behind the wall on which it is mounted through the gap formed between the rotating auger support disc and the wall. Accordingly, there is a need for a seal or shield which prevents the contaminants from working their way between the rotating and nonrotating components of the power auger and fouling or contaminating bearings and other components of the device.

A similar problem exists with mining machinery, which includes powered augers extending outwardly from enclosed motor housings. Typically, such auger devices are operated in hazardous environments which contain fine particles of rock or metal which may corrode or attack the main support bearings for the power augers.

Solutions to this problem include the seal lubrication device disclosed in Hufford et al. U.S. Pat. No. 4,804,194. That patent discloses a seal lubrication mechanism which is employed between a rotating shaft and an outer, cylindrical shaft housing. A block is secured to the rotating shaft and supports a spring which urges a seal ring, which rotates with the shaft, against a stationary seal ring. An annular baffle defines a channel for lubricant to flow to the interface between the rotating and nonrotating seal rings.

A disadvantage with such structure is that it requires spring elements in order to urge the rotating and nonrotating seal rings together. Such spring structures may provide uneven support in instances of shock loading of the shaft.

Accordingly, there is a need for a power auger machine having a bearing shield between the rotating and nonrotating components which is capable of preventing contaminants from working inwardly between the rotating and nonrotating components and fouling or corroding the main bearings and motor structure. In addition, there is a need for such a bearing shield to resist thrust and shock loads and to be easily repairable in the field.

SUMMARY OF THE INVENTION

The present invention is a power auger machine having a bearing shield between the rotating auger support disc and the wall supporting the auger which prevents contaminants from working their way through the gap between the rotating and nonrotating components and fouling the main bearing and motor which powers the auger. The bearing shield includes an outer shield element having an annular channel and attached to the bearing disc which supports the auger, and an inner shield element attached to the wall supporting the main bearings which is positioned within the annular channel. A grease purge seal is positioned rearwardly of the inner shield element and extends between the wall and the bearing disc to form a lubricant manifold which supplies lubricant to the labyrinth passage created by a gap which exists between the outer shield element channel walls and the inner shield element. A pump supplies lubricant to the manifold and sufficient pressure is generated to drive the lubricant through the labyrinth passage and out from the wall.

In a preferred embodiment, the wall includes an annular recess which receives the outer shield element so that the outer shield element is flush with the wall. In addition, the intersection of the outer shield element with the surfaces defining the annular recess in the wall form an extension of the labyrinth seal.

Also in the preferred embodiment, the outer shield element and the inner shield element are segmented and are attached to the bearing disc and rear wall, respectively. This segmentation facilitates repair and inspection in the field.

An advantage of the power auger machine of the present invention equipped with the aforementioned bearing shield is that a single element of the bearing shield can be adjusted in thickness to compensate for the accumulation of out-of-tolerances which may exist with the main bearing structure. Preferably, a gap of several mils is required to form a labyrinth passage between the inner shield element and the outer shield element, and the outer shield element and the annular recess formed in the wall. This gap can be formed precisely by measuring the depth of the recess in the wall, then machining the inner shield element to the appropriate thickness to give the desired gap.

Accordingly, it is an object of the present invention to provide a power auger machine having a bearing shield in which lubricant is placed under pressure to seep gradually outwardly to prevent the inward progression of contaminents toward the main bearings; a power auger machine having a bearing shield which is easily repairable or replacable in the field; a power auger machine having a bearing shield which is relatively simple in construction, containing few elements and not requiring exotic materials; and a power auger machine having a bearing shield which forms a labyrinth passageway for lubricant and can accept lubricants of varying qualities and viscoscities.

Other objects and advantages of the present invention will be apparent from the following description, the accompanying drawings and the appended claims.

DETAILED DESCRIPTION OF THE PREFERRED EMBODIMENT

Figure 1:
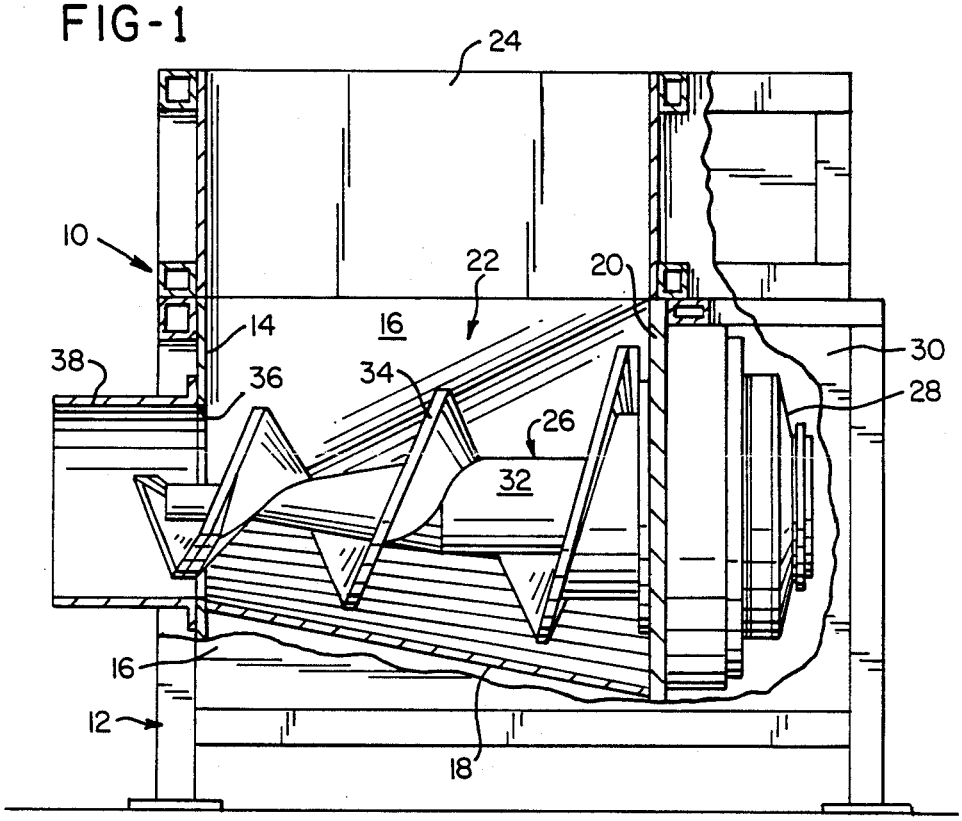
FIG. 1 is a side elevation, partially broken away and in section, of a power auger machine of the present invention.

As shown in FIG. 1, the power auger machine of the present invention, generally designated 10, includes a frame 12 having a front wall 14, side walls 16, a bottom 18 and a rear wall 20, which together define a grinding chamber 22. The top of the grinding chamber is open and communicates with an inlet hopper 24.

Figure 2:
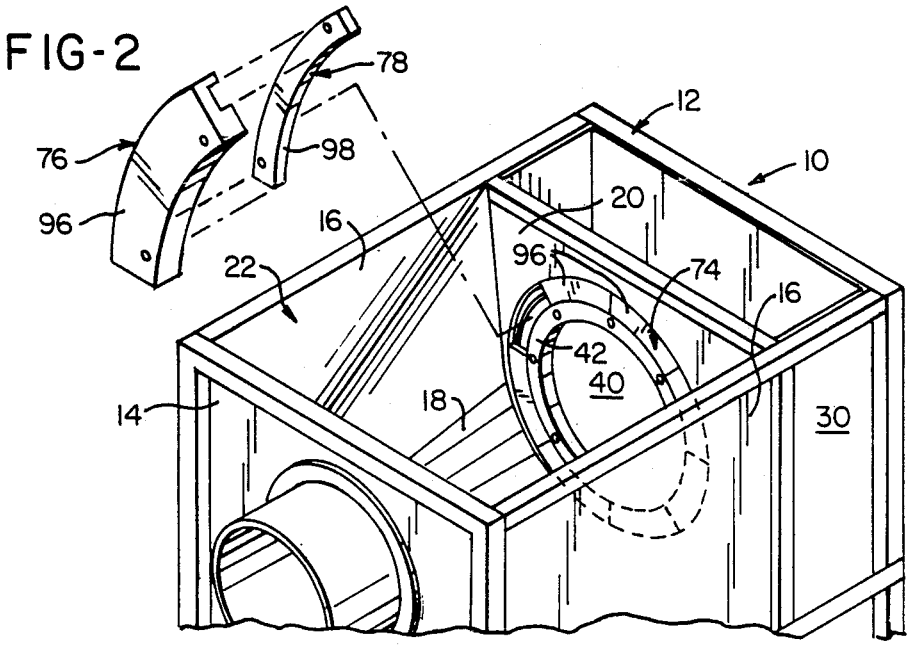
FIG. 2 is a detail in perspective, of the power auger machine of FIG. 1 showing segmented inner and outer shield elements exploded away therefrom.
Figure 3:
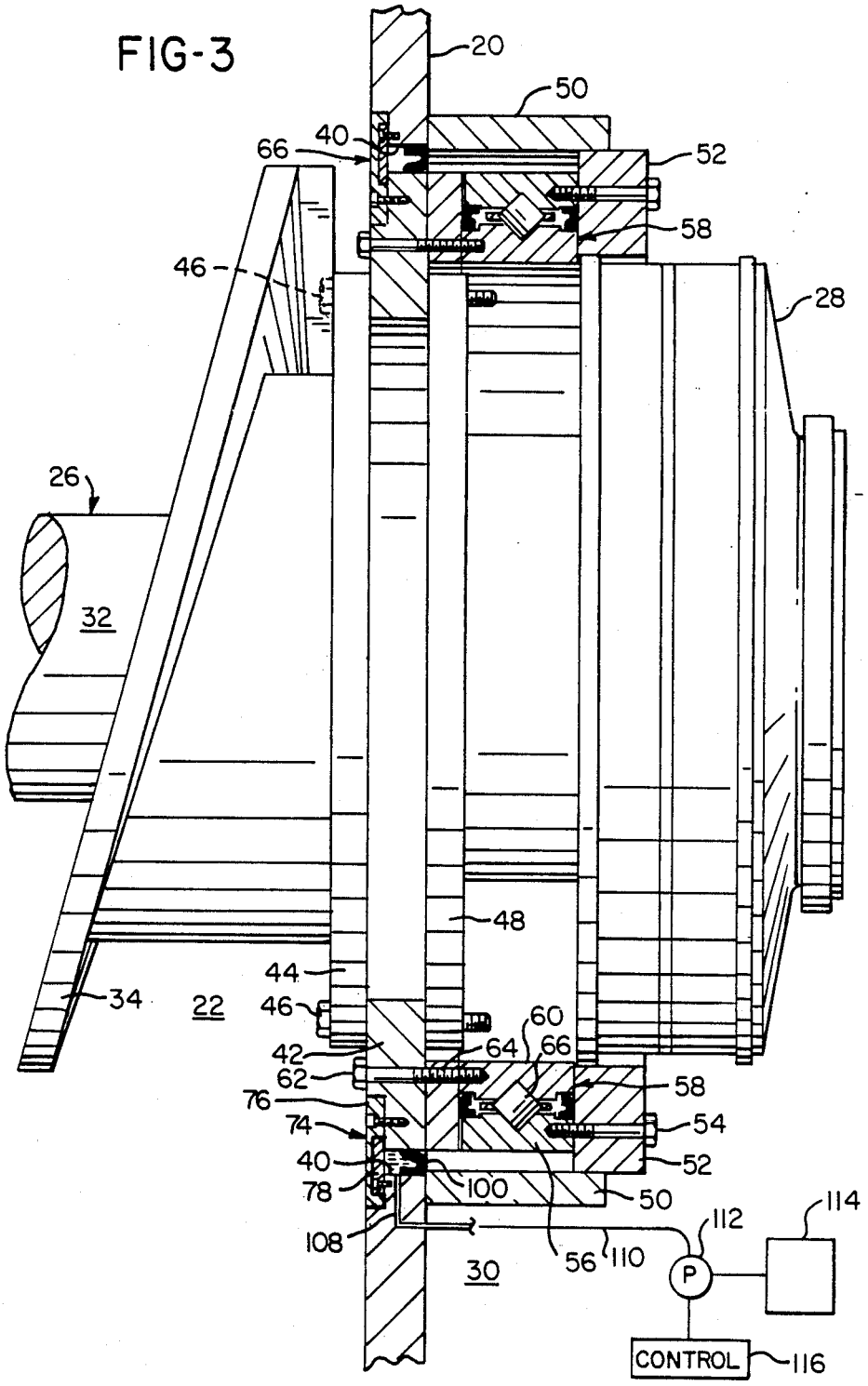
FIG. 3 is a detail side elevation of the power auger machine of FIG. 1, showing the main bearing structure and bearing shield structure.

An auger, generally designated 26, is rotatably supported on the rear wall 20 by structure hereafter described and is driven by a hydraulic motor 28, located within an enclosed equipment housing 30. The auger 26 includes a tapered, cylindrical shaft 32 and a tapered, helical flight 34 which decreases in diameter from the rear wall 20 to the front wall 14. The front wall 14 includes a central opening 36 which receives the outer end of the auger 26 and communicates with a cylindrical extrusion tube 38, mounted on the forward face of the front wall 14. As shown in FIGS. 2 and 3, the rear wall 20 includes a central opening 40 which receives a bearing disc 42. Bearing disc 42 is annular in shape and is attached to a disc shaped auger base 44 by bolts 46. Auger base 44 supports the auger 26 and is attached to the auger shaft 32 and flight 34.

Mounting bolts 46 extend through the auger base 44 and bearing disc 42 and are threaded into motor drive shoe 48. Motor drive shoe 48 is disc-shaped and is rotated by a motor 28.

The rear wall 20 includes an annular extension 50 which is concentric with the opening 40 and extends rearwardly into the equipment housing 30 and annular main bearing mounting ring 52 is attached to the cylindrical extension 50 and is attached by bolts 54 to the outer or stationary race 56 of the main bearing 58, which preferably is a cross roll roller bearing. The inner or rotational race 60 of the main bearing 58 is attached by bolts 62 to the bearing disc 42 and is separated therefrom by a spacer ring 64.

Figure 4:
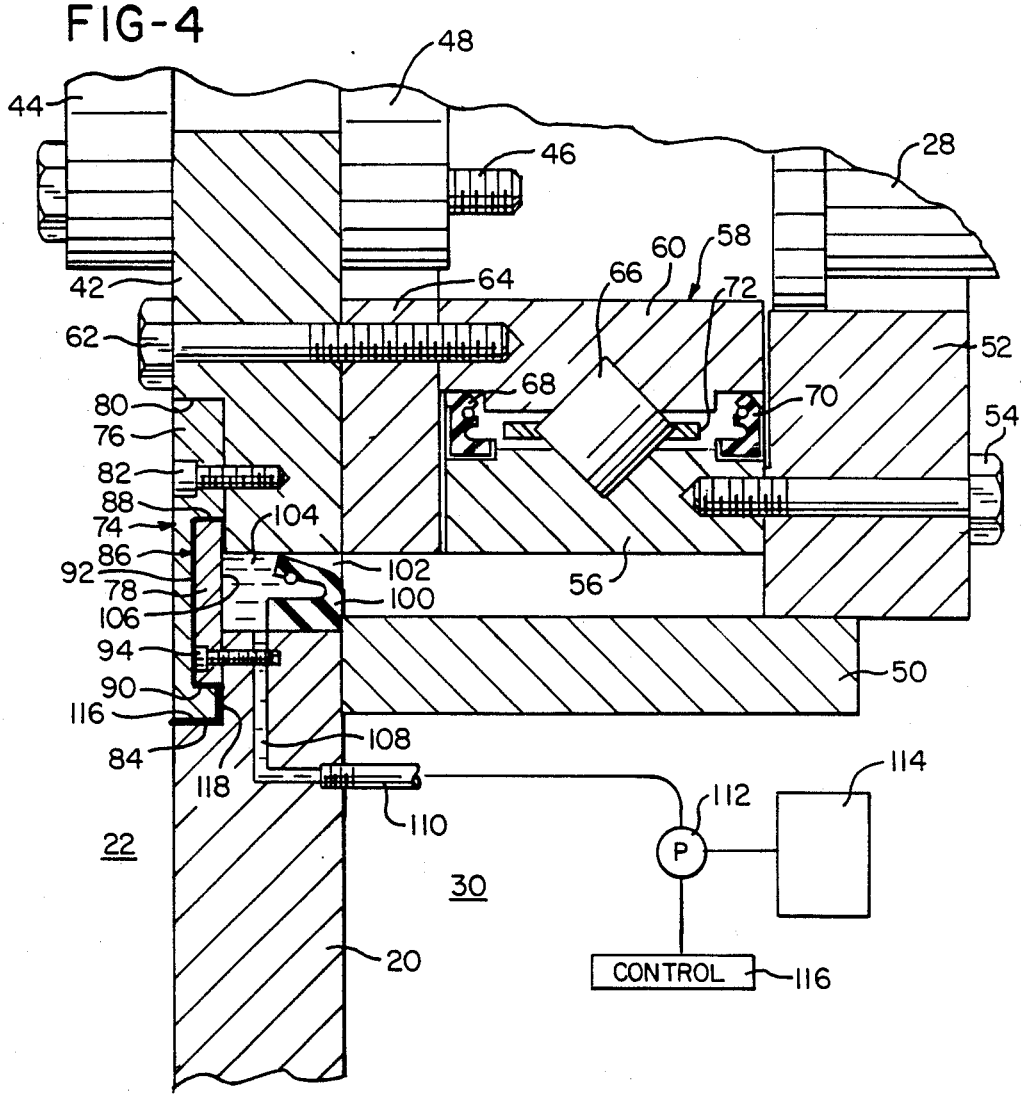
FIG. 4 is a detail side elevation in section of the main bearing structure and bearing shield shown in FIG. 3.

Roller bearing 58 includes a plurality of cylindrical rollers 66 which are contained within a lubricated environment defined by stationary race 56, rotational race 60 and front and rear annular lubricant seals 68, 70 respectively (see FIG. 4). The rollers 66 are spaced by a cage 72 positioned between the lubricant seals 68, 70.

As shown in FIGS. 2, 3 and 4, the gap between the bearing disc 42 and rear wall 20 is covered by a bearing shield, generally designated 74. Bearing shield 74 includes an annular outer shield element 76 and an annular inner shield element 78 The bearing disc 42 includes an outer, peripheral recess 80 within which the outer shield element 76 is seated and is attached by bolts 82. The rear wall 20 includes an annular recess 84, concentric with the opening 40, which receives the radially outer portion of the outer shield element 76 The recesses 80, 84 are sized such that the outer shield element 76 is flush with the outer surface of the rear wall 20.

The outer shield element 76 includes an annular channel 86 which is defined by side walls 88, 90 and bottom face 92. The channel 86 is sized to receive the inner shield element 78, which is attached to the recess 84 by bolts 94. As shown in FIG. 2, the outer shield element 76 comprises a plurality of shield element segments 96 and the inner shield element 78 comprises a plurality of inner shield segments 98.

As shown in greater detail in FIG. 4, an annular grease purge seal 100 extends across the gap 102 which exists between the rear wall 20 and the bearing disc 42 rearwardly of the inner shield element 78. Grease purge seal 100 forms a lubricant supply manifold 104 with the radially outer face of the bearing disc, radially inner face of the rear wall opening 40 and rear face 106 of the inner shield element. A supply conduit 108 is formed in the rear wall of 20 and is threaded to receive a lubricant supply line 110. A pump 112 supplies lubricant from a reservoir 114 through the supply line 110 to the manifold 104. A computer control 116 selectively actuates pump 112 to supply lubricant at a predetermined rate to maintain a predetermined pressure within the supply manifold 104.

The channel 86 formed in the radially outer portion of the outer shield element 76 is spaced inwardly from the outer face 116 of the outer shield element so that a labyrinth seal 118 is formed between the rear wall recess 84, channel 86, bearing disc recess 80 and inner shield element 78. In the preferred embodiment, the aforementioned components are dimensioned such that a five mil gap is formed along the labyrinth seal 118, except accross the bottom face 92 of the inner shield element 78, where the gap is 2 mils. It should be noted that the collective-out-of-tolerance relationships created by the connections of the main bearing 58, spacer block 64, bearing disc 42 and outer shield element 76 can be compensated for simply by proper machining of the inner shield element 78 to the appropriate thickness to provide the desired dimensions for the labyrinth seal 118.

The operation of the power auger machine 10 is as follows. Material to be ground is deposited through the hopper 24 and into the grinding chamber 22 of the machine, in which the motor 28 has already been actuated to to rotate the auger 26 at a predetermined speed, typically between 1 and 30 revolutions per minute. With the particular embodiment of the power auger machine shown in the figures, the material is ground, shredded, compressed and pumped forwardly toward the front wall 14. Simultaneously, the material is compressed into the extrusion tube 38. This mechanical action breaks up the material into finer pieces and, with certain material releases hazardous or corrosive constituents. This may happen when plastic bags of hazardous or biohazardous material are ground, or when 55 gallon oil drums of corrosive industrial waste are ground and shredded.

The forward pumping action of the auger 26 causes a reverse force to be applied against the main bearing 58, which tends to force the outer shield element 76 against the inner shield element 78.

As the auger 26 is rotated by the motor 28, the pump 112 is actuated by the control 116 to force lubricant from the reserviour 114 through the supply line 110 and conduit 108 to the annular manifold 104. The lubricant and the manifold 104 then progresses though the labyrinth seal 118 which takes it first radially inwardly around the radially inner wall 88 of the recess 86, then across the bottom face 92 of the recess, then rearwardly along the radially outer face 90 of the recess. The lubricant then progresses radially outwardly and forwardly as it flows through the gap formed between the outer face 116 of the outer shield element 76 and the opposite face of the annular recess 84 of the rear wall 20. The pump is selectively actuated to provide sufficient hydraulic pressure such that the lubricant gradually oozes forwardly into the grinding chamber 22. This positive pressure ensures that contaminants to not work themselves rearwardly back through the labyrinth seal to foul or contaminate the main bearing 58 or equipment housing 30.

The control 116 also preferably is equipped to detect low lubricant levels in the reservoir and increased operating pressures of the pump 112, which possibly indicate a blockage in the lubricant system or labyrinth seal 118.

In the preferred embodiment, the outer and inner shield elements 76, 78 are made of steel and the inner shield element preferably is made of a hardened steel to withstand the thrust load forces imposed upon it during operation when back pressure is created by the material being shredded and compressed by the auger 26.

While the form of apparatus herein described constitutes a preferred embodiment of their invention, it is understood that the invention is not limited to these precise forms of apparatus, and that change may be made therein without departing from the scope of the invention.

What is claimed is:

1. In a power auger machine of the type having a frame defining a grinding chamber having a substantially vertical rear wall with a centrally-located, circular opening, auger means rotatably mounted on said rear wall for crushing and shredding material in said grinding chamber, motor means mounted on said frame for rotating said auger, and main bearing means for rotatably supporting said auger means on said rear wall, a bearing shield comprising:

an annular outer shield element attached to said auger and having an annular channel formed in a rearward face thereof, said channel having radially inner and outer concentric side walls joined by a radially-extending bottom wall;

an annular inner shield element attached to said rear wall and being sized to fit within said annular channel and form gaps with said side walls, said inner shield element having an outer face in opposing relation to said bottom wall thereby forming a labyrinth seal with said recess;

said rear wall having an annular recess shaped to receive said annular outer shield element such that a forward face of said outer shield element is substantially flush with said rear wall and forms a portion of said labyrinth seal with said annular recess contiguous to said grinding chamber; and means for forcing lubricant through said labyrinth seal such that lubricant bleeds outwardly between said outer shield element and said rear wall into said grinding chamber, whereby contaminants are prevented from entering between said inner and outer shield elements from said grinding chamber.

2. The auger shredder of claim 1 wherein said outer shield element is segmented and each of said segments is individually attachable to and removable from said auger, thereby facilitating repair and replacement thereof.

3. The auger shredder of claim 1 further comprising grease purge seal means extending between said rear wall and a rotating component of said bearing means for defining a lubricant manifold with a rear wall of said inner shield element, said manifold supplying lubricant to said shield elements.

4. The auger shredder of claim 3 wherein said lubricant forcing means includes pump means for forcing lubricant into said lubricant manifold.

5. The auger shredder of claim 4 wherein said lubricant forcing means includes control means for selectively actuating said pump means for maintaining a predetermined pressure of lubricant within said bearing shield.

6. The auger shredder of claim 3 wherein said outer shield element extends radially outwardly from said bearing means and is attached to said bearing means radially inwardly of said channel; and said inner shield element is attached to said rear wall radially outwardly of said manifold, whereby lubricant flows from said manifold radially inwardly about said inner shield element, then radially outwardly across said outer face of said inner shield element, then around a radially outer portion of said outer shield element to said grinding chamber.

7. The auger shredder of claim 1 wherein said bearing shield includes bearing disc means for mounting said auger means, said bearing disk means including said outer shield element extending radially outwardly therefrom.

8. The auger shredder of claim 7 wherein said bearing disc means is connected to a rotatable component of said main bearing means.

9. The auger shredder of claim 8 wherein said outer shield element comprises a plurality of shield element segments, each individually removable from said outer shield element.

10. The auger shredder of claim 1 wherein said inner shield element is segmented and each of said segments is individually attachable to and removable from said rear wall, thereby facilitating repair and replacement thereof.

11. In a device having rotatable auger means for working upon material, wall means for forming a barrier between a dirty environment and a relatively clean environment, said wall means having a circular opening for receiving said auger means and bearing means, located within said clean environment, for supporting said auger means, a bearing shield comprising:

an annular outer shield element attached to said auger and having an annular channel formed in a rearward face thereof;

an annular inner shield element attached to said wall means and being sized to fit within said annular channel and form a labyrinth seal therewith;

said outer shield element including a plurality of outer shield element segments and said inner shield element including a plurality of inner shield element segments, each of said segments being separately attachable to and removable from said device; and means for forcing lubricant from said clean environment, between said inner and outer shield elements and outwardly into said dirty environment as said auger is rotated, whereby contaminants are prevented from entering from said dirty environment to between said inner and outer shield elements.

12. The device of claim 11 wherein said wall means includes an annular recess concentric with said opening and sized to receive said outer shield element such that said outer shield element and said recess form a labyrinth passage continuous with a passage created by said channel and said inner shield element to convey lubricant to said dirty environment.

13. The device of claim 12 wherein said outer shield element includes an annular bearing disc attached to said auger means and having an outer, peripheral recess sized to receive said outer shield element; said outer shield element being attached at a radially inner portion thereof to said peripheral recess such that said annular channel is concentric with said peripheral recess and is spaced radially outwardly thereof.

14. The device of claim 13 wherein said inner shield element is attached at a radially outer portion thereof to said annular recess, whereby said labyrinth passage extends around a radially inner portion of said inner shield segment, radially outwardly along an outer face of said inner shield segment, around a radially outer end of said inner shield segment, and around a radially outward portion of said outer shield element to said dirty environment.

15. The device of claim 14 wherein said inner shield element is sized to compensate for collective out-of-tolerance conditions existing in said bearing means, said outer shield element and said outer peripheral recess.

16. The device of claim 14 wherein said annular recess and said outer peripheral recess are sized such that said outer shield element is flush with said wall means facing said dirty environment.

17. The device of claim 11 wherein said lubricant forcing means includes a lubricant manifold communicating with said inner shield element.

18. The device of claim 17 wherein said lubricant manifold includes a supply conduit extending through said wall means.

19. The device of claim 17 wherein said manifold includes grease purge seal means for containing said lubricant within said manifold, said grease purge seal means extending between said wall means and said bearing disc, whereby said manifold is defined by said wall means, said bearing disc, said inner shield element and said grease purge seal means.

* * * * *